US009345298B2

(12) United States Patent
Bettua et al.

(10) Patent No.: US 9,345,298 B2
(45) Date of Patent: May 24, 2016

(54) PORTABLE CLOSET WITH SEPARABLE TOTE

(75) Inventors: Michael Bettua, Hoboken, NJ (US); Kiran Joseph, Chennai (IN)

(73) Assignee: Max Mirani Investments, LLC, New York, NY (US)

( * ) Notice: Subject to any disclaimer, the term of this patent is extended or adjusted under 35 U.S.C. 154(b) by 0 days.

(21) Appl. No.: 13/884,848

(22) PCT Filed: Nov. 15, 2011

(86) PCT No.: PCT/US2011/060741

§ 371 (c)(1), (2), (4) Date: May 10, 2013

(87) PCT Pub. No.: WO2012/068075

PCT Pub. Date: May 24, 2012

(65) Prior Publication Data

US 2013/0233660 A1 Sep. 12, 2013

Related U.S. Application Data

(60) Provisional application No. 61/413,591, filed on Nov. 15, 2010.

(51) Int. Cl.

| | |
|---|---|
| ***A45C 5/03*** | (2006.01) |
| ***A45C 5/14*** | (2006.01) |
| ***A45C 9/00*** | (2006.01) |

(Continued)

(52) U.S. Cl.

CPC ... *A45C 9/00* (2013.01); *A45C 5/03* (2013.01); *A45C 5/14* (2013.01); *A45C 7/0045* (2013.01); *A45C 2013/026* (2013.01)

(58) Field of Classification Search

CPC .. A45C 13/02; A45C 2013/1026; A45C 5/03; A45C 5/14; A45C 9/00; A45C 7/0045; A45C 13/103; A45C 13/1015

USPC ..... 190/9, 11, 109, 110, 28, 106, 111, 903; 206/281, 284, 282

See application file for complete search history.

(56) References Cited

U.S. PATENT DOCUMENTS 1,520,044 A 12/1924 Wilt
2,341,104 A * 2/1944 Kleber ..... 206/284

(Continued)

FOREIGN PATENT DOCUMENTS

GB 2184938 A * 7/1987

OTHER PUBLICATIONS

Korean Intellectual Property Office, International Search Report and Written Opinion for International Application No. PCT/US2011/060741, issued Jun. 25, 2012.

*Primary Examiner* — Sue A Weaver
(74) *Attorney, Agent, or Firm* — PatentBest; Andrew McAleavey

(57) ABSTRACT

A portable closet (10) with an interior (26) that can be used as a separable tote bag is disclosed. The portable closet is a clamshell-type piece of luggage with wheels (18) and an extendable and retractable handle (68). The interior of the piece of luggage includes at least one fold-down shelf (28, 30), and may include several fold-down shelves, as well as conventional pockets and closable compartments. The interior is connected to the piece of luggage such that it can be removed, folded, and configured as a tote bag. While connected, the interior may be moved aside to permit access to an undivided additional storage compartment behind or beneath it.

20 Claims, 5 Drawing Sheets

(51) Int. Cl.
*A45C 7/00* (2006.01)
*A45C 13/02* (2006.01)

(56) References Cited

U.S. PATENT DOCUMENTS

| | | | | | |
|---|---|---|---|---|---|
| 2,350,606 | A | * | 6/1944 | Gold | 190/124 |
| 2,423,297 | A | * | 7/1947 | Creamer | 206/279 |
| 2,453,663 | A | * | 11/1948 | Hinson | 190/100 |
| 2,533,333 | A | * | 12/1950 | Kitson | 190/111 |
| 2,839,167 | A | * | 6/1958 | Thorlough | 190/108 |
| 3,104,740 | A | * | 9/1963 | Koffler | 190/115 |
| 3,315,772 | A | * | 4/1967 | Katz | 206/287.1 |
| 3,869,034 | A | | 3/1975 | Thornton, Jr. | |
| 4,418,805 | A | * | 12/1983 | Wolff | 206/279 |
| 4,771,871 | A | | 9/1988 | Lambracht | |
| 4,854,432 | A | | 8/1989 | Carpenter | |
| 5,052,555 | A | | 10/1991 | Harmon | |
| 5,407,040 | A | * | 4/1995 | Hu | 190/100 |
| 5,676,223 | A | | 10/1997 | Cunningham | |
| 5,749,447 | A | * | 5/1998 | Hersh et al. | 190/112 |
| 6,334,519 | B1 | * | 1/2002 | Tong | 190/107 |
| 6,976,566 | B1 | | 12/2005 | Skriloff | |
| 7,140,479 | B2 | * | 11/2006 | Mangano et al. | 190/108 |
| 7,207,426 | B2 | * | 4/2007 | Godshaw et al. | 190/1 |
| 7,779,976 | B2 | | 8/2010 | Mangano | |
| 2001/0013452 | A1 | * | 8/2001 | Tiramani et al. | 190/124 |
| 2006/0049016 | A1 | | 3/2006 | Godshaw | |
| 2007/0045072 | A1 | * | 3/2007 | Selvi | 190/103 |
| 2011/0253494 | A1 | * | 10/2011 | Coventry | 190/110 |
| 2012/0222932 | A1 | * | 9/2012 | Wang | 190/110 |

* cited by examiner

PORTABLE CLOSET WITH SEPARABLE TOTE

CROSS-REFERENCE TO RELATED APPLICATIONS

This application claims priority to U.S. Provisional Patent Application No. 61/413,591, filed Nov. 15, 2010. The contents of that application are incorporated by reference herein in their entirety.

TECHNICAL FIELD

The invention relates to luggage and baggage.

BACKGROUND OF THE INVENTION

Luggage is designed to store, transport, and protect possessions while a user is traveling. In its most basic form, a piece of luggage is simply an enclosure with an opening that may be opened and closed to place possessions into the interior of the luggage.

Today, there are two basic types of luggage on the market: hard-sided and soft-sided luggage. These two types of luggage differ primarily in the materials of which their sidewalls are made. Soft-sided luggage has sidewalls that are constructed of layers of fabric, soft rubber, or another flexible material. The sidewall material may be stiffened or stretched across a rigid or semirigid frame to form panels. Hard-sided luggage, on the other hand, has sidewalls that are made of a rigid or semirigid material, such as a metal, plastic, or wood. For example, whereas a soft-sided piece of luggage may use a woven nylon fabric for its sidewalls, a hard-sided piece of luggage may use a material like polycarbonate plastic for its sidewalls. Whether hard-sided or soft-sided, many modern pieces of luggage have integrated wheels and an integrated, telescoping handle. A piece of luggage that includes integrated wheels and a handle is often referred to as an upright roller bag.

Luggage is also commonly classified based on the configuration of its storage space. In a classic piece of luggage, the sidewalls and bottom of the piece provide most of the storage volume, while the top or cover panel typically has fairly little depth compared to the sidewalls and is hingedly connected to one of the sidewalls. However, a second type of luggage, called "clamshell" luggage, has gained in popularity. In a piece of clamshell luggage, there are two halves or sides of substantial depth that are hingedly connected to one another, typically along the bottom. In most cases, the two halves are of essentially equal depth, and are releasably attached to each other along the non-hinged sides by a zipper or other fasteners.

In many cases, the internal volume of a piece of luggage is open and undivided, although some pieces of luggage do include internal dividers or pockets, and most luggage includes straps or netting to prevent possessions from shifting during transport. Luggage that provides an open, undivided internal volume or compartment gives users the most flexibility, because possessions may be of any size, as long as they fit within the compartment, and can be arranged however the user chooses. However, luggage with an undivided internal compartment can be inconvenient because it can easily become disorganized, requiring the user to fully or partially unpack at his or her destination, or to hunt through the entire compartment of the luggage in order to find possessions.

Luggage with internal compartments or dividers can ameliorate some of these problems, but usually at the expense of flexibility.

SUMMARY OF THE INVENTION

One aspect of the invention relates to a piece of luggage. The piece of luggage is of the clamshell type, with two shells, each of substantial depth, hingedly mounted at their respective bottoms to a bottom portion. Gusset material is provided along the bottom portion and sides that allows the two shells to open fully with respect to one another. The interior portion of the piece of luggage has at least one fold-down shelf. The fold-down shelf has an at least partially rigid front piece, which is pivotably attached to the interior portion at a bottom edge. Gusset material attaches on each side end of the front piece and connects to the interior portion. In a typical embodiment, the interior portion may have two or more fold-down shelves, as well as a number of enclosed compartments, such that substantially the entirety of the interior portion is divided into shelves and compartments.

The interior portion is releasably connected to the piece of luggage by fasteners, such as a zipper or snaps, so that it may be partially disconnected or moved aside to reveal an additional storage compartment between the interior portion and an interior face of the shells. The additional storage compartment is typically undivided, extending the entire height and width of the interior of the luggage, and may include retaining structures, such as straps, netting, or hanger hooks or bars. The interior portion may also be fully disconnected from the piece of luggage, and includes features, including closing fasteners and handles or handle-attaching structure, that allow it to be used as a tote bag. With the interior portion fully disconnected, the full, undivided volume of the piece of luggage can be used for storage.

These and other features, aspects, and advantages of the invention will be set forth in the description that follows.

BRIEF DESCRIPTION OF THE DRAWING FIGURES

The invention will be described with respect to the following drawing figures, in which like numerals represent like elements throughout the figures, and in which.

DETAILED DESCRIPTION

Figure 1:
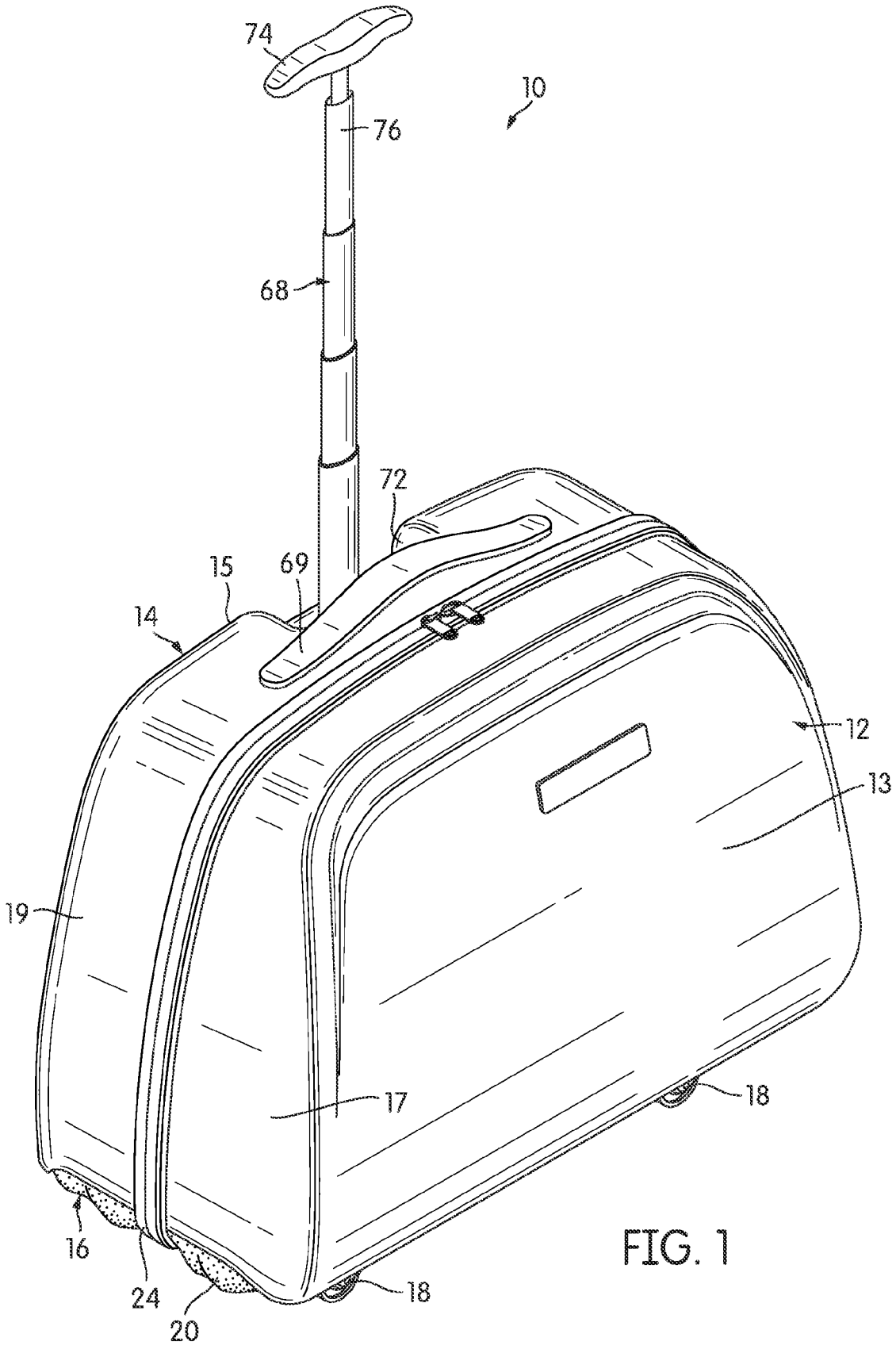
FIG. 1 is a perspective view of a piece of luggage according to one embodiment of the invention.

FIG. 1 is a perspective view of a piece of luggage, generally indicated at 10, according to one embodiment of the invention. The piece of luggage 10 is of the clamshell type, in this case with two shell portions 12, 14 of substantially equal depth that are connected to one another along the bottom of the luggage 10 such that they move hingedly with respect to a bottom portion 16. Of course, the depth of the two shell portions 12, 14 need not be equal in all embodiments; instead, each shell portion 12, 14 may have a different depth.

In the illustrated embodiment, the luggage 10 is hard-sided, with the two shell portions 12, 14 being formed of a rigid or semirigid material. Any number of rigid or semirigid materials may be used to form the shell portions 12, 14 in embodiments of the invention, including metals, plastics, woods, and composite materials. Particular examples include polycarbonate, acrylonitrile-butadiene-styrene (ABS), polypropylene, and polyvinyl chloride (PVC) plastics; metals such as aluminum and steel; and composites, such as carbon fiber composite and glass fiber composite.

Plastics and polymeric materials used for the shell portions 12, 14 may be either solid or foamed. In some cases, for example, a foam such as an ethylene-vinyl acetate (EVA) foam of appropriate thickness may be used to form the shell portions 12, 14. Another example of a suitable material for making the shell portions 12, 14 is a thermoplastic urethane (TPU). U.S. Provisional Patent Application No. 61/441,577, filed Feb. 10, 2011, discloses methods for thermoforming TPU to make luggage parts, and is incorporated by reference herein in its entirety.

The thickness of the shell portions 12, 14 will depend on the particular material that is used, the size and desired strength of the piece of luggage 10, the desired weight of the piece of luggage 10, and other conventional design considerations. For example, if the shell portions 12, 14 are made of polycarbonate, a thickness of 2 mm may be appropriate.

In the illustrated embodiment, each of the two shell portions 12, 14 is a unitary piece with a major area or portion 13, 15 that forms one of the two largest sidewalls of the piece of luggage 10 and a contiguous depending lip 17, 19 that extends perpendicularly from the major area or portion 13, 15 on at least three sides to form additional sidewalls and to define the shape and volume of the piece of luggage 10. Overall, the major area 13, 15 of each shell portion 12, 14 has a generally trapezoidal shape, giving the piece of luggage 10 as a whole the shape of a generally trapezoidal prism, wider at the bottom than at the top. Of course, the piece of luggage 10 may have essentially any shape, including square, rectangular, and rounded shapes, so long as the shape can be produced.

Although each shell portion 12, 14 is a unitary piece in the illustrated embodiment, that need not be the case in all embodiments. For example, the major area 13, 15 of each shell portion 12, 14 could be manufactured separately from the lip 17, 19 and assembled during manufacture, and the lip 17, 19 may be made in several pieces that are later assembled. If the material of which the shell portions 12, 14 are made is a plastic, a molding process, such as injection molding, may be used. For metals, production processes such as machining and stamping may be used, whereas composite materials may be formed by conventional resin impregnation techniques.

Figure 2:
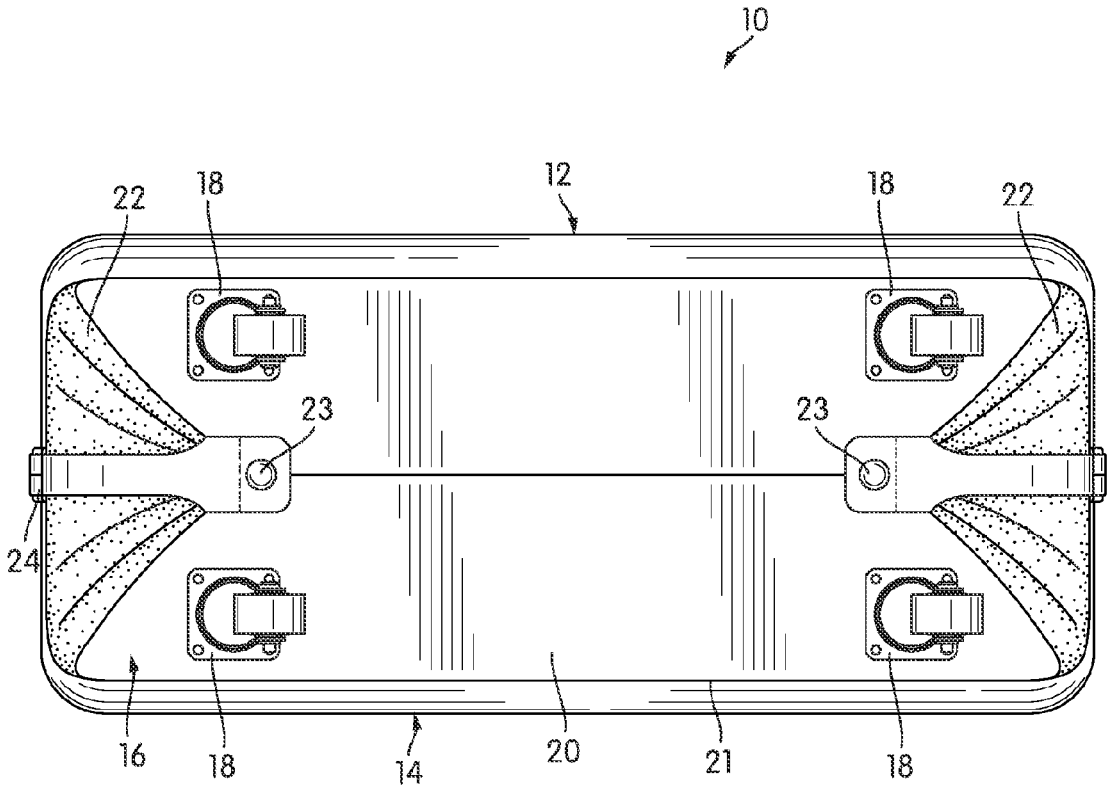
FIG. 2 is a plan view of the bottom of the piece of luggage of FIG. 1.

FIG. 2 is a bottom plan view of the piece of luggage 10. As was noted briefly above, the shell portions 12, 14 are hingedly connected to a bottom portion 16. The bottom portion 16 includes both rigid and flexible materials and provides connection points for the two shell portions 12, 14 and a plurality of wheels 18. At the center of the bottom portion is a rigid bottom member 21, comprised of a material such as a rigid metal, plastic, wood, or composite. (In the view of FIG. 2, the bottom member 21 is covered by a flexible gusset material 20, as will be described below in more detail.) For example, the rigid bottom member 21 may be a 2-3 mm thick rectangle of corrugated or "honeycomb" polypropylene. The shell portions 12, 14 may be connected to the rigid bottom member by, for example, a contiguous piece of fabric, such as nylon fabric, or other gusset material that is adhesively bonded, sewn, fused or otherwise adhered to each shell portion 12, 14. The fabric or gusset material may then be wrapped around, bonded, sewn, or otherwise secured to the rigid bottom member. In some cases, seams and connections in the piece of luggage 10 may be by redundant or multiple means. For example, fabric linings and gusset materials may be both sewn and bonded to the shell portions 12, 14.

As can be seen in FIGS. 1 and 2, the outer surface of the bottom portion 16 is covered with a flexible gusset material 20, which extends upward and meets the shell portions 12, 14 along their sides. In the illustrated embodiment, the gusset material 20 may be, for example, a 300-denier nylon or a ballistic nylon. Of course, any sufficiently durable and flexible material may be used, including fabrics, rubbers, and other types of elastomeric polymers. The gusset material 20 provides enough material or "slack" to allow the two shell portions 12, 14 to open relative to one another. When the two shell portions 12, 14 are fully closed, the edges 22 of the gusset material 20 extend outwardly from the sides of the bottom portion 16, making generally triangular shapes when fully extended. Snaps 23 are provided on the underside of the bottom portion 16 in order to secure the edges 22 in place when the piece of luggage 10 is fully closed. Snaps, hook-and-loop fasteners, or other means of securement may alternatively be provided along the sidewalls or the bottom of the piece of luggage 10. (When the piece of luggage 10 is in a fully open position, such as that shown in FIG. 3, the gusset material 20 is taut, generally flat, and extends in the same plane as the sides of the shell portions 12, 14.)

The wheels 18 are attached to the rigid bottom member 21 within the bottom portion 16, and may be attached by any suitable means, including rivets or screws. Typically, the fasteners used to secure the wheels 18 are driven through the gusset material 20 and the rigid bottom member 21, further connecting the materials of the bottom portion 16. While any type of wheels 18 may be used, the wheels 18 of the piece of luggage 10 are most advantageously caster-type wheels that are capable of swiveling, e.g., 360°.

The two shell portions 12, 14 are connected along three sides by a zipper 24 that begins in the edges 22 of the gusset material 20 and extends around the shell portions 12, 14 to the other side. The zipper 24 may include gusset material of its own that is rubberized or otherwise waterproofed to keep water from seeping into the interior of the piece of luggage 10. In some embodiments, depending on the material of which the shell portions 12, 14 are made, the zipper 24 may be covered by piping, flaps, or other structures designed to conceal it and to prevent water and other undesirable elements from seeping in.

As shown in FIG. 1, one of the two shell portions 12, 14 also carries a telescoping handle assembly 68, which is secured to the interior face of the shell portion 14 and extends upwardly through an opening (not shown in the perspective of FIG. 1) in the top edge of the shell portion 14. The opening is set within a molded recess 72 in the shell portion 14, which allows the handle 74 of the handle assembly 68 to rest flush within the recess 72 when the handle assembly 68 is fully retracted. Although the handle assembly 68 uses a single telescoping member 76 of oval cross-section, pieces of luggage according to embodiments of the invention may use any kind of telescoping handle assembly and any kind of support member. In particular, handle assemblies with two side-by-side telescoping members may be used. As those of skill in the art will realize, the number of segments in the telescoping member 76 will vary based on the height of the piece of luggage 10, the desired height of the fully extended handle assembly 68, and the desired level of rigidity in the telescoping member 76, as well as other factors. In addition to the telescoping handle assembly 68, a gripping handle 69 is provided along the top of the piece of luggage 10, fixedly attached to one of the shell portions 12, 14, to allow the piece of luggage 10 to be picked up. Other gripping handles may be provided in any convenient or necessary locations.

Figure 3:
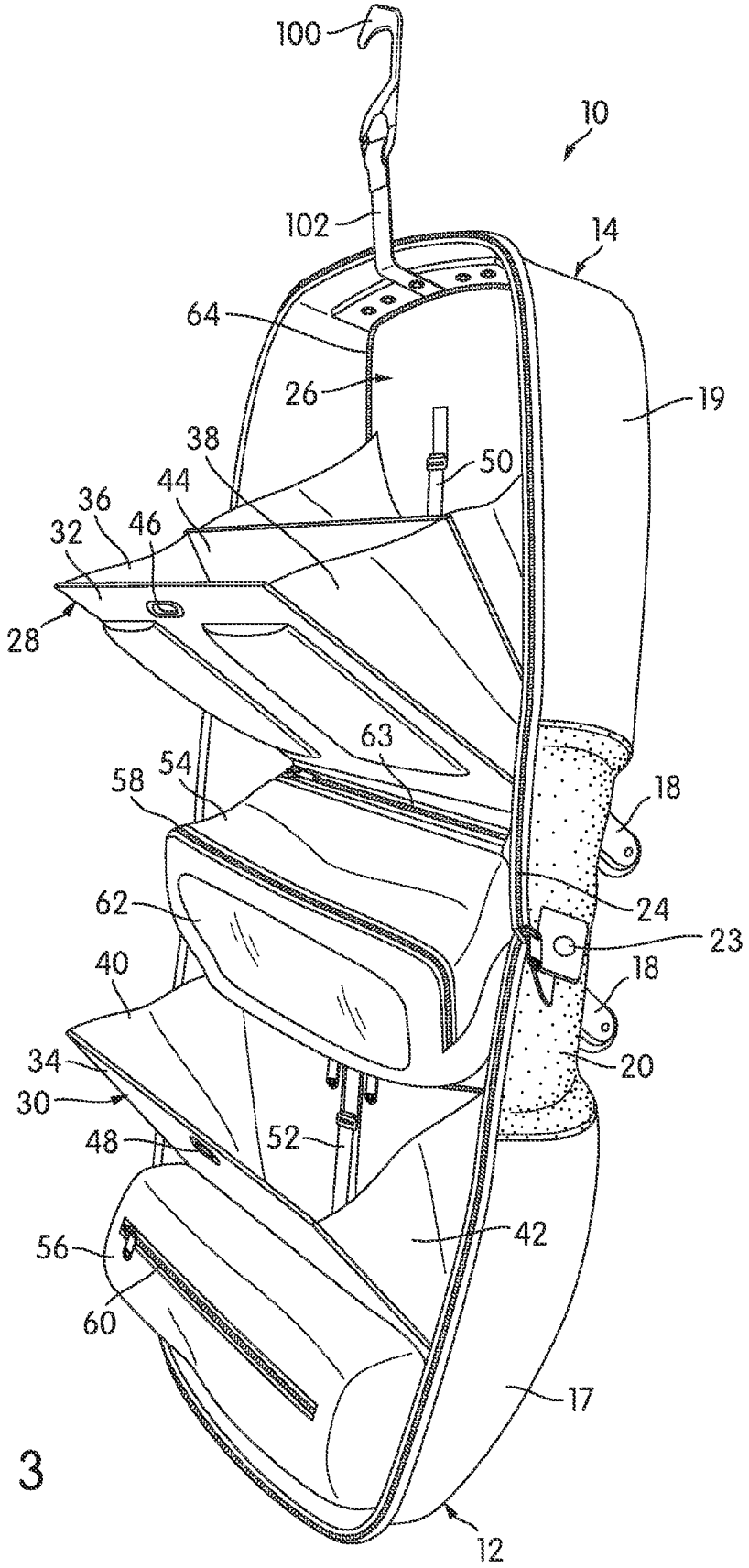
FIG. 3 is perspective view of the interior of the luggage.

FIG. 3 is an interior perspective view of the piece of luggage 10, shown in its fully open position. As will be described in more detail below, the piece of luggage 10 provides an interior with a number of fold-down shelves and pockets, acting, in essence, as a portable closet, and allowing users to keep their possessions organized as they travel. However, the piece of luggage also advantageously provides another feature: the portion that provides the shelves and organizing features is separable from the interior of the piece of luggage 10, such that it may be detached and used as its own tote bag, or interchanged with another interior portion that has another internal configuration.

In the configuration shown in the view of FIG. 3, the removable interior 26 of the piece of luggage has two main fold down shelves 28, 30, one fold-down shelf 28 at the top of the interior 26 and another fold-down shelf 30 below it. Each fold-down shelf includes a main shelf panel 32, 34 that is hingedly connected to the interior 26 at its bottom, and two flexible side gusset panels 36, 38, 40, 42 that are connected between the side edges of the main shelf panel 32, 34 to define respective sides of the fold-down shelf 28, 30. Each main shelf panel 32, 34 typically comprises a rigid or semirigid insert covered with or secured between inner and outer layers of fabric, such as soft nylon. The rigid or semirigid insert may be, for example, 1 mm polypropylene sheet. The side gusset panels 36, 38, 40, 42 may be comprised of the same flexible, soft nylon fabric with which the rigid or semirigid insert is covered. It should be understood that while stiffening the main shelf panel 32, 34 may be helpful, it is not necessary to do so in all embodiments.

More than one panel may be present in each fold-down shelf 28, 30. For example, in the upper fold-down shelf 28, a second shelf panel 44 is hingedly connected to the interior 26 and is positioned behind the main shelf panel 32, with a common set of side gusset panels 36, 38 coupling the main and second shelf panels 32, 44. Thus, each fold-down shelf 28, 30 may actually comprise a set of folding shelves in some configurations. Additional flexible material similar to the side gusset panels 36, 38 could be used in the interior of a fold-down shelf 28, 30 to divide the shelf into multiple compartments along its length.

In the illustrated embodiment, the fold-down shelves 28, 30 are not fully enclosed; rather, they are open from the top. However, each main shelf panel 32, 34 has a slot 46, 48 sized to accept a cinching strap 50, 52. Each cinching strap 50, 52 is a flexible strap secured to the interior 26 at one end (e.g., by stitching in a pattern such as a box-and-cross stitch) at a position proximate to the top of a folded up shelf 28, 30, and each strap 50, 52 has complementary portions of hook and loop fastener along its length. Thus, each cinching strap 50, 52 can be passed through its corresponding slot 46, 48 and drawn back on itself to cinch and retain the fold-down shelves 28, 30 in an upward position. This can be useful in preventing clothing and other possessions from falling out of the shelves 28, 30. In other embodiments, the straps 50, 52 may include snaps, a hook or buckle system, or any other type of fastening mechanism.

The interior 26 of FIG. 3 also includes two fully enclosed or closable compartments 54, 56. Each compartment includes a zipper 58, 60, and one compartment includes a transparent portion 62 to allow its contents to be visualized. The transparent portion may be made of transparent PVC, or another clear or transparent plastic. Alternatively, the transparent portion 62 could be made of mesh or another open fabric.

The two fully closable compartments 54, 56 also illustrate some of the range of features that may be provided in interiors 26 according to embodiments of the invention. In particular, the compartments 54, 56 may be constructed to shield their contents from view, or they may provide openings, translucent, or transparent portions 62 that allow the contents to be seen. Zippers 58, 60 and openings may be placed along the top, front, side, or any other convenient face of the compartment. Additionally, some compartments may be separable from the interior 26. For example, compartment 54 is attached to the interior 26 by a zipper 63 that allows it to be disconnected and reconnected to the interior 26.

In a typical configuration of the interior 26, most of the space will be divided into and between fold-down shelves 28, 30 and closable compartments 54, 56, although the form and number of the shelves and compartments may vary from embodiment to embodiment. In some embodiments, each compartment 54, 56 and shelf 28, 30 may have a suggested use, which may be pointed out by labels, words, or graphic icons.

Since the interior 26 of the piece of luggage 10 has fold-down shelves 28, 30 and is designed to keep contents organized, users may not need to unpack while traveling. For that reason, the piece of luggage 10 includes a hook 100 sized to be hung on a closet bar. The hook 100 is connected to a strap 102 that is riveted, screwed, or otherwise permanently fastened to an upper interior panel of shell 14. Thus, a user can hang the piece of luggage 10 in a closet.

As was noted briefly above, the interior 26 of the piece of luggage 10 is removable. A zipper 64 is located near the perimeter of the interior 26. The path or track of the zipper 64 follows the entire perimeter of the interior 26, terminating adjacent to its starting point. (Only a portion of the zipper 64 can be seen in the view of FIG. 3.) When the zipper 64 is fully unzipped, the interior 26 can be disengaged from the piece of luggage 10, as shown in the exploded perspective view of FIG. 4. Although the illustrated embodiment uses a zipper 64 to engage the interior 26 with the piece of luggage 10, as those of skill in the art will understand, other types of fasteners, including snaps, may be used.

The interior 26 is itself comprised of multiple layers of material. The innermost layer of material 66 is typically a soft, high-sheen nylon, a microsuede, or another suitable lining material. An outer layer of material 80 is attached to the inner layer and is typically a more durable and wear-resistant material, such as ballistic nylon or a 300 denier nylon, that is suitable for exterior use. In a typical embodiment, a stiffening panel is secured between the inner and outer layers 66, 80 of material. The stiffening panel may be, for example, a 1-2 mm polypropylene sheet. In other embodiments, the outer layer of material 80 of the interior 26 may be a rigid or semirigid material of the type described above with respect to the shell portions 12, 14.

As was also noted briefly above, the interior 26 includes features that allow it to be used as a tote bag when separated from the piece of luggage 10. Specifically, a pair of handles 82, 84 are attached to the outer layer of material 80. Additionally, a second zipper 86 is set into the perimeter of the interior 26, near the zipper 64 that connects the interior 26 with the piece of luggage 10. The arrangement of the two zippers 64, 86 is such that the second zipper 86 is concealed when the zipper 64 is zipped and the interior 26 is thus connected to the piece of luggage 10. The second zipper 86 allows the interior 26 to be folded and zipped up into a tote bag with closed sidewalls.

In addition to the handles 82, 84, the interior 26 may have any conventional features to allow it to be used conveniently as a tote bag. For example, it may include appropriately placed rings or other structures to allow a shoulder strap to be connected to it. In fact, in some cases, instead of the handles 82, 84, the interior 26 may include only handle attachment or connection structures such as rings; the handles themselves may be attached after the interior 26 is disconnected from the piece of luggage 10. The interior 26 may also include any number of additional interior or exterior pockets and compartments to allow additional items to be stored and conveniently retrieved. Those pockets and compartments may or may not be accessible when the interior 26 is attached to the piece of luggage 10.

In the illustrated embodiment, the piece of luggage 10 has additional features that may be used with the interior 26 removed. Specifically, a hanger ring 88 is attached near the top of the open piece of luggage 10. The hanger ring 88 allows a conventional hanger to be hung in the piece of luggage 10, so that a suit or dress can be stored between the interior 26 and the shell portions 12, 14. In normal use, the interior 26 may be partially unzipped using the zipper 64 and swung or folded out of the way to allow access to any items that are hung, folded, or otherwise stored in the additional compartment, generally indicated at 89, between the interior and the shell portions 12, 14. That additional compartment 89 typically extends substantially the entire height and width of the interior space of the piece of luggage 10, and is usually undivided.

In some cases, if a user wishes to have the flexibility of using the entire volume of the piece of luggage 10 without the organizing features provided by the interior 26, he or she may simply disconnect the interior 26, set it aside, and use the piece of luggage 10 as a conventional, open volume piece. For that reason, in addition to the hanger ring 88, straps, netting, or other securing features may be provided in the piece of luggage 10 to prevent clothes or other items from shifting during transport.

Figure 4:
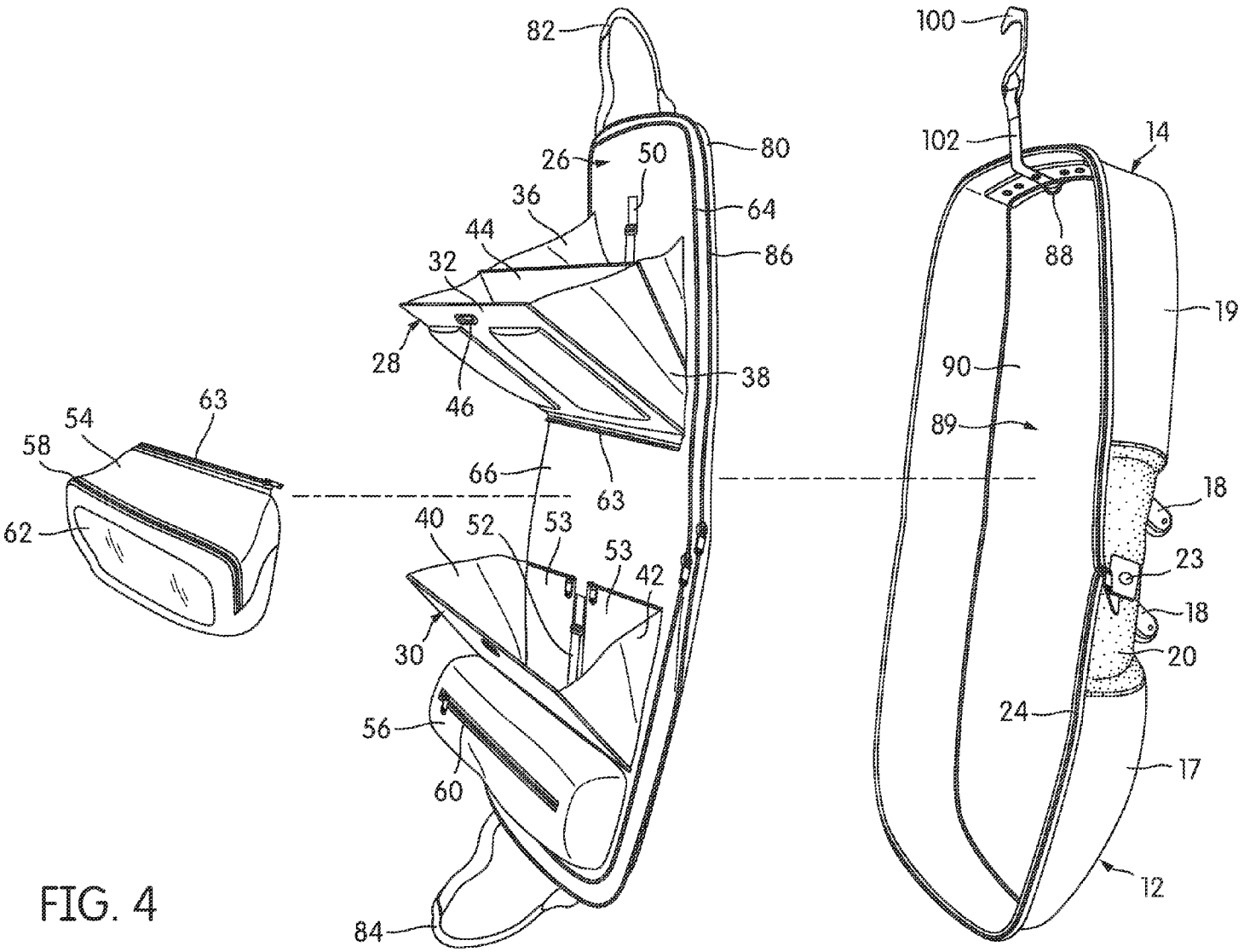
FIG. 4 is an exploded perspective view of the luggage, showing the separable interior and shell portions.

As shown in FIG. 4, the piece of luggage 10 also has an additional layer of lining material 90 that is exposed when the interior 26 is removed. This additional layer of lining material 90 is typically the same kind of material used for the innermost layer of material 66 of the interior 26, although it need not be in all embodiments. The additional layer of lining material 90 conceals the handle assembly 68, the shell portions 12, 14, and the other elements of the piece of luggage 10. A break or opening may be provided in the additional layer of lining material 90 in order to allow for repairs. The break or opening may be secured with a zipper, snaps, hook-and-loop fastener, or any other suitable means.

The exploded perspective view of FIG. 4 also shows one of the enclosed compartments 54 separated from the interior 24 using its zipper 63. As shown in FIG. 4, there are two zippered 53 pockets just under and below the removable compartment 54 that can be accessed easily if the compartment 54 is either moved out of the way or detached.

Figure 5:
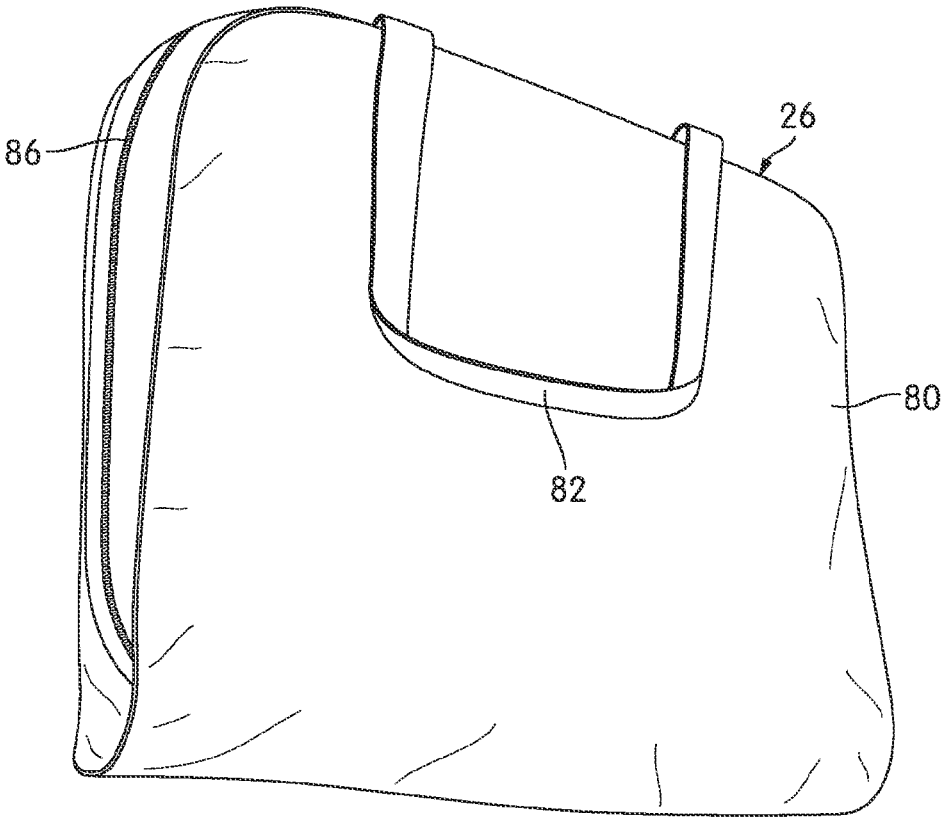
FIG. 5 is a perspective view of the interior of the piece of luggage, removed from the piece of luggage and configured as a tote bag.

FIG. 5 is a perspective view of the interior 24 of the piece of luggage 10 removed from the shells 12, 14 and placed into its tote bag configuration. One of the handles 82 and the zipper 86 are visible. As was noted briefly above, the interior 24 may include any number of pockets, side pockets, or other elements that are useable in the tote bag configuration.

While the invention has been described with respect to certain embodiments, the embodiments described are intended to be exemplary, rather than limiting. Modifications and changes may be made within the scope of the invention, which is defined by the following claims.

What is claimed is:

1. A piece of luggage, comprising:

first and second shells, each of the first and second shells defining a height, a width, and a substantial depth;

a bottom panel connected between and hingedly connecting the first and second shells at respective bottom edges thereof for movement between a closed position, in which the first and second shells are complementarily opposed to one another, defining an interior space within, and open positions, in which the interior space is accessible;

an interior portion having an innermost layer that acts as a lining and organizer for the piece of luggage, an outermost layer that faces the first and second shells when the interior portion is installed in the piece of luggage, at least one fold-down shelf including an at least partially rigid front panel hingedly connected along a bottom edge to the interior portion, and gusset panels connected between the front panel and the interior portion on opposing sides perpendicular to the bottom edge, the gusset panels defining sides of the at least one fold-down shelf and allowing the front panel to pivot forwardly relative to the interior portion, thereby increasing the volume of the fold-down shelf;

the interior portion also having handle structure or handle attaching structure provided on the outermost layer of the interior portion, a first zipper attached along an entire edge of the interior portion to connect the interior portion to lining gusset material that is attached to the first and second shells, and a second zipper attached continuously around the interior portion outwardly of the first zipper, the second zipper being arranged to connect to itself to allow the interior portion to fold and be configured as a bag or tote when the interior portion is removed from the interior space; and an additional storage compartment defined between a rear of the interior portion and an inner face of one of the first or second shells, the first zipper being arranged such that the interior portion can be moved aside or partially disconnected to allow access to the additional storage compartment.

2. The piece of luggage of claim 1, further comprising:

a telescoping handle assembly carried by the first shell or the second shell such that a telescoping handle member with a handle on one end is accessible from the exterior of the piece of luggage; and a set of wheels fixedly attached to the bottom panel.

3. The piece of luggage of claim 1, wherein the substantial depths of the first and second shells are essentially equal to one another.

4. The piece of luggage of claim 1, wherein the first and second shells are formed of a substantially rigid material.

5. The piece of luggage of claim 4, wherein the substantially rigid material comprises polycarbonate.

6. The piece of luggage of claim 1, wherein the outermost layer is made of a durable, wear-resistant material;

the innermost layer is made of a soft, compliant material; and one or more at least substantially rigid stiffening panels interposed between the outermost layer of material and the innermost layer of material.

7. The piece of luggage of claim 1, wherein the additional storage compartment comprises one or more retaining structures selected from the group consisting of straps, netting, a hanger bar, and a hanger ring.

8. The piece of luggage of claim 1, wherein the additional storage compartment extends essentially the entire height and width of the interior space and is undivided.

9. The piece of luggage of claim 1, wherein the bottom panel is covered with a flexible gusset material that, at least in part, connects the bottom panel hingedly with the first and second shells.

10. The piece of luggage of claim 1, wherein the first and second shells are trapezoidal, such that the widths are greater toward the bottom panel.

11. The piece of luggage of claim 1, wherein the arrangement of the first and second zippers is such that the second zipper is concealed when the first zipper is fully zipped.

12. A piece of luggage, comprising:

first and second shells, each of the first and second shells defining a height, a width, and a substantial depth;

a bottom panel connected between and hingedly connecting the first and second shells at respective bottom edges thereof for movement between a closed position, in which the first and second shells are complementarily opposed to one another, defining an interior space within, and open positions, in which the interior space is accessible; and an interior portion removably connected to the interior space of the piece of luggage, the interior portion having an innermost layer that acts as a lining and organizer for the piece of luggage, an outermost layer that faces the first and second shells when the interior portion is installed in the piece of luggage, handle structure or handle attaching structure provided on the outermost layer of the interior portion, and a first continuous set of fasteners attached along an entire edge of the interior portion to connect the interior portion to lining gusset material that is attached to the first and second shells, and a second continuous set of fasteners attached continuously around the interior portion outwardly of the first continuous set of fasteners, the second continuous set of fasteners being arranged to connect to themselves to allow the interior portion to fold and be configured as a bag or tote when the interior portion is removed from the interior space; and an additional storage compartment defined between a rear of the interior portion and an inner face of one of the first or second shells, the first continuous set of fasteners being arranged such that the interior portion can be moved aside or partially disconnected to allow access to the additional storage compartment.

13. The piece of luggage of claim 12, wherein the first and second continuous sets of fasteners comprise first and second zippers.

14. The piece of luggage of claim 12, wherein the interior portion further comprises at least one fold-down shelf including an at least partially rigid front panel hingedly connected along a bottom edge to the interior portion; and gusset panels connected between the front panel and the interior portion on opposing sides perpendicular to the bottom edge, the gusset panels defining sides of the at least one fold-down shelf and allowing the front panel to pivot forwardly relative to the interior portion, thereby increasing the volume of the fold-down shelf.

15. The piece of luggage of claim 12, further comprising:

a telescoping handle assembly carried by the first shell or the second shell such that a telescoping handle member with a handle on one end is accessible from the exterior of the piece of luggage; and a set of wheels fixedly attached to the bottom panel.

16. The piece of luggage of claim 12, wherein the substantial depths of the first and second shells are essentially equal to one another.

17. The piece of luggage of claim 12, wherein the first and second shells are formed of a substantially rigid material.

18. The piece of luggage of claim 17, wherein the substantially rigid material comprises polycarbonate.

19. The piece of luggage of claim 12, wherein the outermost layer is made of a durable, wear-resistant nature material;

the innermost layer is made of a soft, compliant nature material; and one or more at least substantially rigid stiffening panels interposed between the outermost layer of material and the innermost layer of material.

20. The piece of luggage of claim 12, wherein the arrangement of the first and second continuous sets of fasteners is such that the second continuous set of fasteners is concealed when the first continuous set of fasteners is fully engaged.

* * * * *